United States Patent [19]

Matsuyama

[11] Patent Number: 4,832,652

[45] Date of Patent: May 23, 1989

[54] CIRCULAR, FOLDABLE TOY

[75] Inventor: Yasushi Matsuyama, Tokyo, Japan

[73] Assignee: Tomy Kogyo Co., Inc., Tokyo, Japan

[21] Appl. No.: 78,636

[22] Filed: Jul. 28, 1987

[30] Foreign Application Priority Data

Aug. 7, 1986 [JP] Japan ..... 61-121832

[51] Int. Cl.[4] ..... A63H 5/00; A63H 33/00; A63H 27/00

[52] U.S. Cl. ..... 446/397; 446/46; 446/487; 273/424

[58] Field of Search ..... 446/46, 47, 397, 415, 446/487; 273/424, 425

[56] References Cited

U.S. PATENT DOCUMENTS 4,115,946 9/1978 Vukmirovich ..... 446/46
4,173,839 11/1979 Kovac ..... 446/46
4,204,357 5/1980 Harrington ..... 446/47
4,279,097 7/1981 Walker ..... 446/46
4,709,928 12/1987 Willingham ..... 446/46

*Primary Examiner*—Robert A. Hafer
*Assistant Examiner*—Charles H. Harris
*Attorney, Agent, or Firm*—Staas & Halsey

[57] ABSTRACT

A plastic film including indicia such as letters and/or a picture thereon is stretched across a continuous elastic circular member to form a planar toy. A player holds the elastic circular member on opposite sides by both hands, twists the elastic circular member into a figure 8 shape, and then folds the elastic circular member into three overlapping portions, which configuration is retained until disturbed. When the folded toy is thrown at an object, the toy opens to the original, flat, circular shape with a frightening sound, while simultaneously displaying the indicia.

8 Claims, 2 Drawing Sheets

CIRCULAR, FOLDABLE TOY

BACKGROUND OF THE INVENTION

The present invention relates to an amusement device and, more particularly, to a "joke" apparatus.

An example of a conventional joke apparatus is a chewing gum pack including one stick of gum attached to a leaf spring. When a person attempts to pull the stick out at the offering of another, the biased stick snaps the person's finger, makes a noise and frightens the person.

There is also known a joke apparatus in the form of a lighter. In this apparatus, when striking the lighter, electricity is transmitted to a metal body of the lighter to instantly give an electric shock to the user's hand so that the user gets frightened and quickly lets go of the lighter.

The foregoing conventional joke apparatuses have generally been only confectionery and articles for daily use. There have been no joke toys, per se developed. Nevertheless, there is a demand for a joke toy, capable of creating frightening actions and sounds.

SUMMARY OF THE INVENTION

To achieve the foregoing and other objects of the present invention and in accordance with the purposes of the invention, there is provided a plastic film stretched on an elastic circular member. The film includes indicia such as letters and/or a picture on the surface thereof. The player holds the elastic circular member at opposite sides by both hands, twists the circular member into a figure 8 shape, and then folds the circular member into three overlapping portions by further twisting and contracting the elastic member. The toy holds the folded position until the toy is thrown and hits an object, such as the floor, wherein the toy abruptly opens to its original circular shape with a sound to frighten bystanders.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The preferred embodiment of the present invention will now be described in detail with reference to FIGS. 1 to 4.

Figure 1:
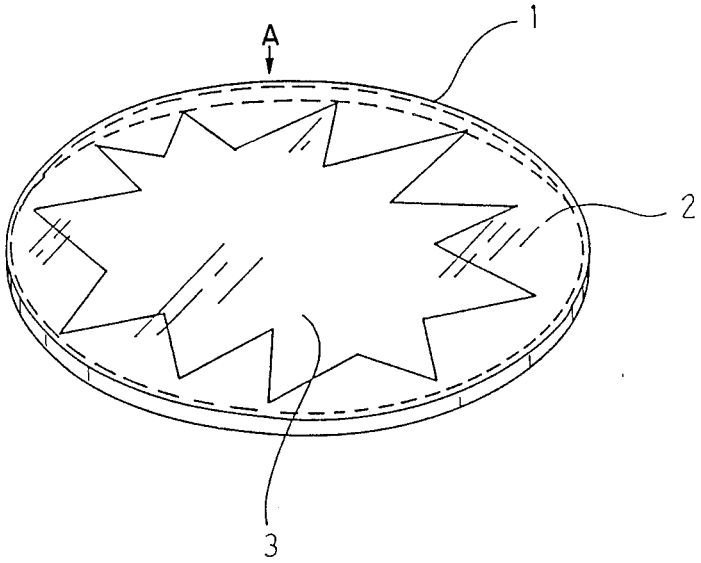
FIG. 1 is a perspective view showing an open state of the toy of the present invention.

FIG. 1 is a perspective view showing an "open" state of the joke toy A of the present invention. Reference numeral 1 denotes an elastic member which is a normally substantially elastic member formed in a circular shape. The elastic member 1 is preferably a continuous metal or plastic leaf spring having a strong elastic force and some rigidity.

The elastic member 1 has stretched thereon a film 2 made of, e.g., vinyl chloride or nylon. Vinyl chloride or nylon is preferred since each has a tensile strength large enough not to get torn even when the elastic member 1 is folded into three and then further restored to its original shape as described below. A surface of the film 2 is provided with a display 3 including indicia such as alphabet letters and/or a picture.

For example, if the letters "wah!" are included on the display 3 and the elastic member 1 is thrown to unfold with a sound at one's feet, as described below, the joke toy A not only frightens a bystander, but also gives a comical impression of the letters "wah!" suddenly appear, thus enhancing the effect of the joke toy A. Alternatively or in addition, a picture of a scary object, such as KING KONG or DRACULA, could be included as indicia on the display 3. In this manner, when the joke toy A unfolds, a scary picture accompanies the sound. Advertising can also constitute the indicia on the display.

Next, the use of the joke toy A of the present invention will be explained with reference to FIGS. 2–4.

Figure 2:
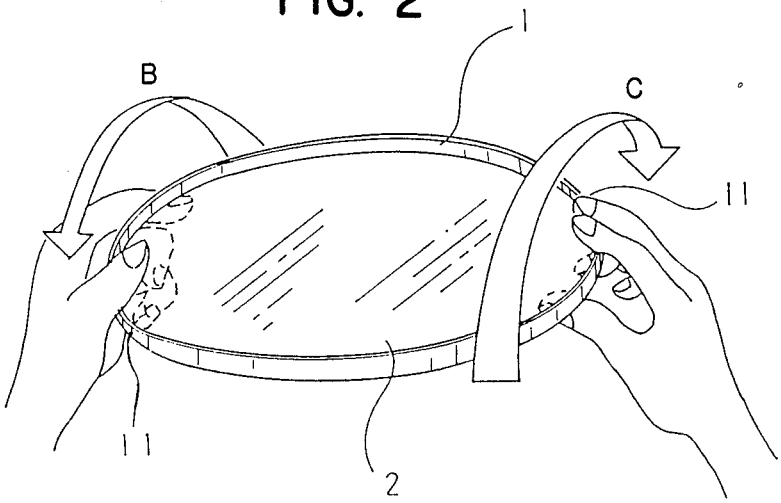
FIG. 2 is a perspective view of the toy of the present invention showing placement of the hands on the opposite edges thereof before twisting.
Figure 3:
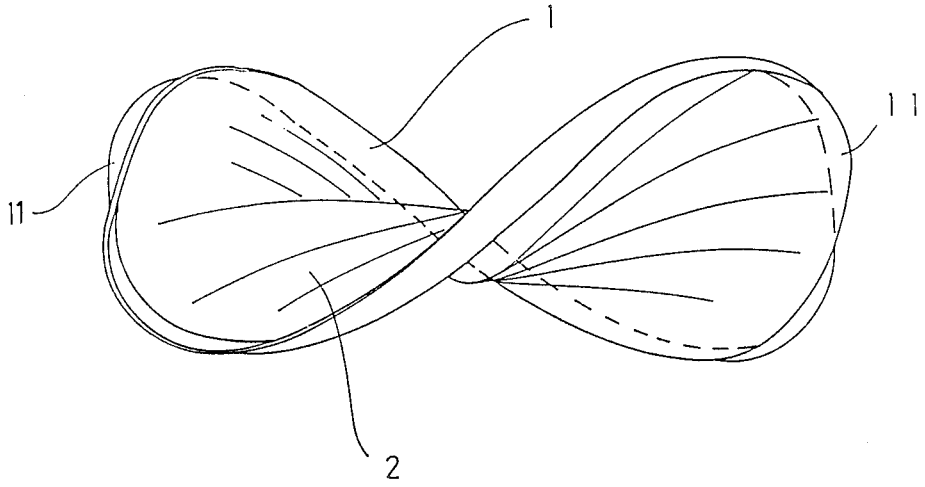
FIG. 3 is a perspective view of the toy of the present invention after being twisted into a figure 8.
Figure 4:
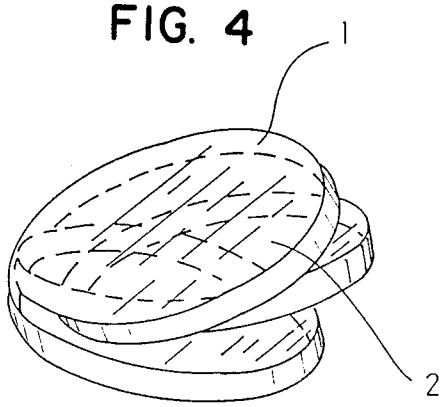
FIG. 4 is a perspective view of the toy of the present invention with three portions thereof folded to overlap each other.

First the user holds the two opposite sides 11, 11 of the elastic member 1 with both hands and twists the elastic member 1 in the directions of the respective arrows B, C shown in FIG. 2 until the elastic member 1 is deformed to a figure 8 shape shown in FIG. 3. Subsequently, the player continues to twist and contract the elastic member 1 until it naturally folds into three overlapping portions as shown in FIG. 4, which shape it retains until disturbed.

When the folded elastic member 1 is thrown at an object, such as at the floor near a bystander, the elastic member 1 is immediately and explosively restored to its original circular shape shown in FIG. 1 upon hitting the object. The joke toy A simultaneously gives off a sound as it unfolds to frighten the bystander. Further, the letters and/or the picture displayed on the surface of the plastic film 2 stretched on the elastic member 1 imparts a comical, scary or advertising message, as the case may be.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. A method of amusement, comprising the steps of:

(a) placing hands on opposite sides of an elastic member configured as a circular plane, wherein the elastic member includes:

(i) a first member having a first position in which it is configured as a circular, planar shape and a second position in which it is configured as a continuous, three-part folded over shape; and (ii) a second member stretched across the first member;

(b) twisting the elastic member into a figure 8 configuration;

(c) further twisting and contracting the elastic member to form three portions folded over on each other; and (d) throwing the elastic member against an object, whereupon the elastic member returns to said circular planar configuration and makes a noise.

2. The method as recited in claim 1, wherein the elastic member comprises:

a metal leaf spring.

3. The method as recited in claim 1, wherein the elastic member comprises:

a plastic leaf spring.

4. The method as recited in claim 1, wherein the second member comprises:

a vinyl chloride film.

5. The method as recited in claim 1, wherein the second member comprises:

a nylon film.

6. The method as recited in claim 1 further comprising indicia formed on a surface of the second member.

7. The method as recited in claim 1, wherein the indicia is alphabet letters.

8. The method as recited in claim 1, wherein the indicia is a picture.

* * * * *